United States Patent [19]

Osawa et al.

[11] Patent Number: 4,683,184

[45] Date of Patent: Jul. 28, 1987

[54] ELECTROPHOTOSENSITIVE MEMBER HAVING ALTERNATING AMORPHOUS SEMICONDUCTOR LAYERS

[75] Inventors: Izumi Osawa, Ikeda; Isao Doi, Toyonaka; Toshiya Natsuhara, Amagasaki, all of Japan

[73] Assignee: Minolta Camera Kabushiki Kaisha, Osaka, Japan

[21] Appl. No.: 753,587

[22] Filed: Jul. 10, 1985

[30] Foreign Application Priority Data

Jul. 16, 1984 [JP] Japan ..... 59-147920

[51] Int. Cl.[4] ..... G03G 5/082

[52] U.S. Cl. ..... 430/57; 430/60; 430/95

[58] Field of Search ..... 430/57, 84, 60, 95

[56] References Cited

U.S. PATENT DOCUMENTS

| | | | |
|---|---|---|---|
| 4,451,546 | 5/1984 | Kawamura et al. | 430/60 |
| 4,490,450 | 12/1984 | Shimizu et al. | 430/84 |
| 4,491,626 | 1/1985 | Kawamura et al. | 430/95 |

FOREIGN PATENT DOCUMENTS

| | | |
|---|---|---|
| 56-150753 | 11/1981 | Japan . |
| 57-115552 | 7/1982 | Japan . |
| 58-154850 | 9/1983 | Japan . |

*Primary Examiner*—John L. Goodrow

*Attorney, Agent, or Firm*—Burns, Doane, Swecker & Mathis

[57] ABSTRACT

An electrophotosensitive member for use in electrophotography includes a plurality of amorphous silicon and amorphous silicon:germanium layers that are arranged in an alternating fashion. The two outermost layers are made up of amorphous silicon so that each amorphous silicon:germanium layer is sandwiched between two amorphous silicon layers.

13 Claims, 9 Drawing Figures

ELECTROPHOTOSENSITIVE MEMBER HAVING ALTERNATING AMORPHOUS SEMICONDUCTOR LAYERS

BACKGROUND OF THE INVENTION

The present invention relates to an electrophotosensitive member, and more particularly to a photosensitive member having a plurality of amorphous silicon:germanium photoconductive layers.

Amorphous silicon:germanium (hereinafter referred to as a-Si:Ge), because of its small band gap as compared with amorphous silicon (hereinafter referred to as a-Si), shows a high absorption toward long wavelength light. Since, therefore, it contributes to the generation of many carriers and improvement in the sensitivity toward long wavelength light, it is expected to be used in the future as a photosensitive member for printers using semiconductor laser light. Also, since its sensitivity toward short-wave light is not damaged, it can be applied to plain paper copies (hereinafter referred to as PPC) by regulating the emission spectrum of exposure lamps. Also, a-Si:Ge has an excellent feature in that, because it absorbs long wavelength light, there is little disturbance of images by interference of light frequently encountered in the conventional amorphous silicon (a-Si) photosensitive members.

Because of these features, many studies for applying a-Si:Ge to photosensitive members are being made.

For example, there are disclosed a technique to use a-Si:Ge over the whole region of a photosensitive layer [Japanese Patent Application Kokai (Laid-open) No. 171038/1983]; a technique to apply a-si:Ge directly on a conductive base of a photosensitive member (U.S. Pat. No. 4,490,450); and a technique to apply a-Si:Ge to a layer in direct contact with the surface layer and/or substrate of a photosensitive member (ibid., No. 150753/1981). But, none of these techniques makes a proposal to apply a plural number of a-Si:Ge layers.

For example, said patent application No. 17-1038/1983 includes the formation of a-Si:Ge layer over the whole region of a photosensitive layer, but a-Si:Ge has its own defect in that it is small in $\mu\tau$ (carrier range) and low in carrier-carrying efficiency. When a-Si:Ge is therefore applied over the whole region of a photosensitive layer, generated carriers are trapped by the a-Si:Ge layer to cause not only reduction of sensitivity, but also generation of light fatigue and residual potential.

Also, as described in said U.S. Pat. No. 4,490,450 and in said Japanese Patent Application Kokai (Laid-open) No. 150753/1981, when the a-Si:Ge layer has been applied to the base of the photosensitive layer, because of a-Si:Ge being easy to generate thermally excited carriers, injection of charges at the base becomes easy to cause reduction of charging capability. Besides, when the thickness of the a-si:Ge layer is made large in order to eliminate interference patterns generated in printers using semiconductor laser ray or long-wave coherent light as a light source, carriers present in the vicinity of the base are trapped by the a-Si:Ge layer to cause reduction in sensitivity and generation of light fatigue and residual potential.

Further, as disclosed in Japanese Patent Application Kokai (Laid-open) No. 150753/1981, when the a-Si:Ge layer has been applied to the outermost surface of photosensitive members, carriers excited by short-wave light cannot migrate to move out of the layer to fail to contribute to sensitivity. While, when the thickness of the a-Si:Ge layer is made large in order to inhibit interference of light, carriers are trapped in the layer. Also, since a-Si:Ge generates a large number of thermally excited carriers, it causes injection of charges from the surface and this obviously lowers the charging capability.

For this reason, the foregoing conventional techniques do not make the best use of the excellent characteristics of a-Si:Ge.

On the other hand, Japanese Patent Application Kokai (Laid-open) No. 154850/1983 discloses an example of providing triple layers of a-Si:Ge to form the photosensitive member which has a photosensitivity extending to the long wavelength region. But the object of this photosensitive member is to control specific resistance and conductivity. This patent application does not refer at all to the use of a plural number of a-Si:Ge layers as a means for solving the problems encountered in using a-Si:Ge, i.e. a reduction in carrier-carrying efficiency accompanied by reduction of sensitivity and generation of light fatigue and residual potential.

As described above, a-Si:Ge, because of its small band gap as compared with a-Si, shows a high absorption toward long wavelength light, and therefore, it contributes to the generation of many carriers and improvement in the sensitivity toward long wavelength light.

But, the function of electrophotosensitive members does not work at all by mere doping of Ge. For example, high degrees of doping of Ge, when carried out randomly, increase the impurity level in the band gap to cause a reduction in the charging accepting capability which should be said to be the life of electrophotosensitive members. As a result, excellent electrostatic latent images are no longer obtained.

Also, since a-Si:Ge will increase the number of carriers generated but disturbs the movement of them, careless increasing of the amount of Ge added as well as the thickness of the a-Si:Ge layer makes the movement of carriers impossible, thereby causing the reduction of sensitivity, generation of residual potential, etc. In addition, because erasing is not also sufficiently attained, there occur very unfavorable results for electrophotography such as generation of memory etc.

On the other hand, in electrophotography with coherent light as a light source such as laser beam printers, etc., sufficient absorption of long wavelength light should be carried out in order to inhibit the generation of interference phenomenon.

SUMMARY OF THE INVENTION

It is accordingly a primary object of the present invention to provide a novel electrophotosensitive member free of the aforedescribed disadvantages and having an excellent property for obtaining images of good qualities.

Another object of the present invention is to provide an electrophotosensitive member which includes a plurality of amorphous silicon layers and a plurality of amorphous silicon:germanium layers and which is low in residual potential and high in charge accepting capability as well as in sensitivity.

Still another object of the present invention is to provide an electrophotosensitive member which includes a plurality of amorphous silicon:germanium layers each having a depletion layer and which has high sensitivity and high charge accepting capability.

These and other objects of the present invention can be accomplished by providing an electrophotosensitive member which comprises on a conductive substrate a plurarity of amorphous silicon layers and a plurality of amorphous silicon:germanium layers wherein each of said amorphous silicon:germanium layers is so formed to be sandwiched by said amorphous silicon layers. Preferably, each of said amorphous silicon:germanium layers has a depletion layer.

By the foregoing construction of the photosensitive member according to the present invention, the amorphous silicon:germanium layers may be made thin and charge carriers generated in these layers are effectively extracted out to adjacent amorphous silicon layers without being trapped thereby remarkably improving the sensitivity and the charge accepting capability. Further by providing the depletion layer, the mobilities of charge carriers are enhanced to further improve the sensitivity and the charge accepting capability.

DETAILED DESCRIPTION OF THE INVENTION

Figure 1A:
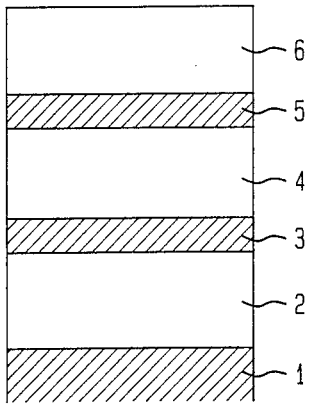
FIGS. 1-*a* to 1-*d* and FIG. 2 show typical sectional views of the photosensitive members of the present invention.
Figure 1B:
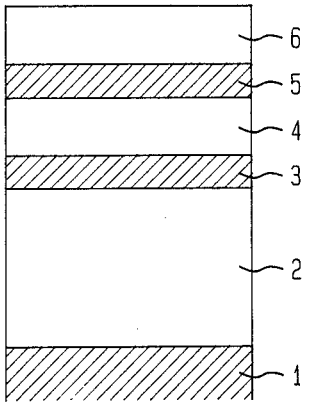
Figure 1C:
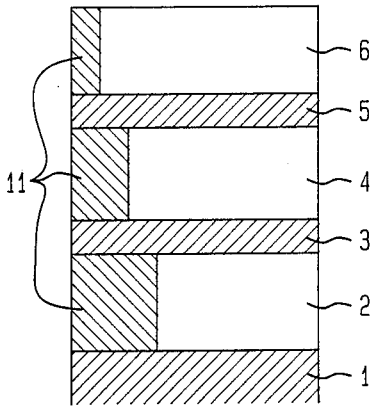
Figure 1D:
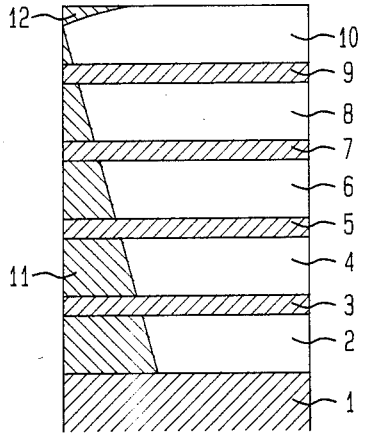

In accordance with the first feature of the present invention, the photosensitive member comprises on a conductive substrate a plurality of a-Si layers and a plurality of a-Si:Ge layers in an alternate fashion in that each of said a-Si:Ge layers is sandwiched by said a-Si layers. By this construction, the photosensitive member is highly sensitive to a long wavelength light of 700 nm or more without increasing each thickness of a-Si:Ge layers. Further, charge carriers generated in the a-Si:Ge layers are easily extracted out of the layers to an adjacent a-Si layer so that there is hardly any rise of residual potential.

For the detailed description by referring to FIGS. 1-*a* to 1-*d, FIG. 1-a* shows an embodiment with three a-Si layers, i.e., first, second and third a-Si layers (2), (4), (6) superposed on a conductive substrate (1) with a first a-Si:Ge layer (3) sandwiched by said first and second a-Si layers (2), (4) and a second a-Si:Ge layer (5) sandwiched by said second and third a-Si layers (4), (6). In this embodiment as well as in other embodiments, it should be noted that each of a-Si layers and a-Si:Ge layers may contain proper hetero atoms such as O, N, C, B, P, etc.

In FIG. 1-*a,* the thickness of each of a-Si layers and each of the a-Si:Ge layers are substantially same. However, as shown in FIG. 1-*b,* the thickness of the first a-Si layer (2) may be increased. The thickness of other layers may vary. By charging and exposing the photosensitive members of FIGS. 1-*a* and 1-*b* to a long wavelength light such as a semiconductor laser beam, the light is primarily absorbed by the first and second a-Si:Ge layers (3) and (5). This is to say that the a-Si layers because of their large band gaps are poor in absorbing the long wavelength light, the light image exposed is primarily absorbed by the second a-Si:Ge layers (5) and further by the first a-Si:Ge layer (3). By this, charge carriers are generated in each of a-Si:Ge layers and move into adjacent a-Si layers to neutralize the surface charges as well as to escape to the substrate. As the mobilities $\mu\tau$ of a-Si layers are high, the charge carriers are effectively transported and those carriers moving through the first and second a-Si:Ge layers are also transported therethrough as these layers have relatively thin thickness compared with the a-Si layers.

In the present invention, the a-Si:Ge layer is formed so as not to come into direct contact with the substrate and surface.

The thickness of each a-Si:Ge layer is preferably made 50 Å to 20 μm. When the thickness is less than 50 Å, the reduction of the sensitivity toward long wavelength light based on a-Si:Ge layers is caused, so that application to laser beam printers (hereinafter referred to as LBP), etc. becomes impossible. While, when it is more than 20 μm, generation of light fatigue becomes easy and residual potential tends to rise. The total thickness of the a-Si:Ge layers is preferably 100 Å to 30 μm. Although dependent on the number of a-Si:Ge layers formed in the photosensitive member, the thickness of each of a-Si:Ge layers should preferably be 100 Å to 5 μm.

The Ge atom concentration in each of the a-Si:Ge layer is preferably within a range of 2 to 70 atomic % (hereinafter referred to as at%), more preferably 8 to 50 at% based on the total number of Si atoms and Ge atoms. When the Ge atom concentration is small, the thickness of the layer may be made large.

The light characteristics of the a-Si:Ge layer may be improved by incorporating other elements such as carbon, oxygen, nitrogen, etc. in the layer. Incorporation of oxygen is effective in terms of improvement in charging capability and reduction in light fatigue. The amount of oxygen is preferably made 0.01 to 5 at% based on Si atoms.

There is no limitation to the number of a-Si:Ge layers formed, and any number not less than 2 will do.

The thickness of each of a-Si layer is 1 to 50μm, more preferably 1 to 25 μm. When it is less than 1 μm, the charge injection-inhibiting effect at the time of charging becomes poor to cause reduction in charging capacity. When it is more than 50 μm, there appear adverse effects that the movement distance of carriers becomes so long that opportunity for the carrier to be trapped increases, and therefore that a rise in residual potential is caused.

Further, carbon, oxygen, nitrogen, etc. may be incorporated in the a-Si layers. Incorporating carbon in the a-Si surface layer results in improvement in the moisture resistance of the surface as well as improvement in charge retention and light permeability. The carbon content is not less than 35 at%, particularly preferably not less than 50 at% based on the total amount of the Si and C atoms.

Oxygen or nitrogen is particularly useful to improve dark resistance and reduce light fatigue. Particularly, incorporating much oxygen in the a-Si layer in contact with the substrate is effective to prevent charge injection at the substrate and improve the charging capacity of the photosensitive member. The oxygen content is 0.05 to 5 at%, more preferably 0.1 to 2 at% based on the Si atom.

Further, the polarity may be adjusted by incorporating an atom belonging to Group III or Group V of the periodic table in the a-Si layers. FIG. 1-*c* shows an embodiment in which the polarity of a photosensitive member used in a positively charged state has been adjusted by incorporating an atom (11) of Group III A, preferably boron, in the a-Si layers (2), (4) and (6). Specifically, the amount of boron included in the first a-Si layer (2) is largest, intermediate in the second a-Si layer (4) and smallest in the third a-Si layer (6). The amount of boron controls the conductivity of the each layer and with the increased amount of boron, an a-Si layer becomes P-type and with a minor amount it becomes N-type. Thus, in the case of positive charging, holes would have to move to the substrate and electrons to the surface of the third a-Si layer (6). The first a-Si layer (2) is so doped with B to have a relatively strong P-type conductivity so that holes move smoothly to the substrate while at same time, preventing injection of negative charges from the substrate. The second a-Si layer (4) is relatively a weak P-type or intrinsic type and this allows both the holes and electrons to move. The third a-Si layer (6) contains the least amount of boron and the conductivity thereof is intrinsic or N-type. In this way, injection of positive charges from the surface of the third a-Si layer (6) is prevented to improve the charge acceptance. The third layer (6) may instead contain Group VA atoms (preferably P) or neither B nor P. In the case of negative charging, the amount of B in each layer would b contrariwise. The first and second a-Si:Ge layers (3) and (5) may similarly contain B or P. Although dependent on various conditions, a-Si or a-Si:Ge without B or P is generally N-type and becomes P-type with more than 10 ppm of B. On the other hand, the inclusion of P or less than about 5 ppm of B makes a-Si and a-Si:Ge N-type. And 5 to 10 ppm of B will make a-Si and a-Si:Ge intrinsic.

In FIG. 1-d, third and fourth a-Si:Ge layers (7), (9) and fourth and fifth a-Si layers (8), (10) are further formed alternately. The Group III A atom (11) of B is incorporated in a gradient manne such that its amount gradually decreases toward the outermost layer (10). In the region close to the surface of the outermost layer (10), P is incorporated.

The amount of the atom of Group III incorporated is not more than 200 ppm, more preferably 3 to 100 ppm based on the Si atom. The amount of the atom of Group V incorporated is not more than 50 ppm, more preferably 1 to 20 ppm based on the Si atom.

Figure 2:
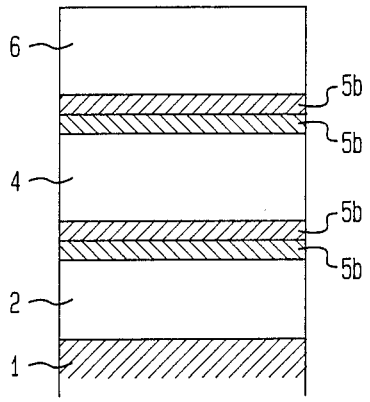

In the photosensitive member of the present invention, a depletion layer may be made by adjusting the polarity of the a-Si:Ge layer as shown in FIG. 2.

Figure 3:
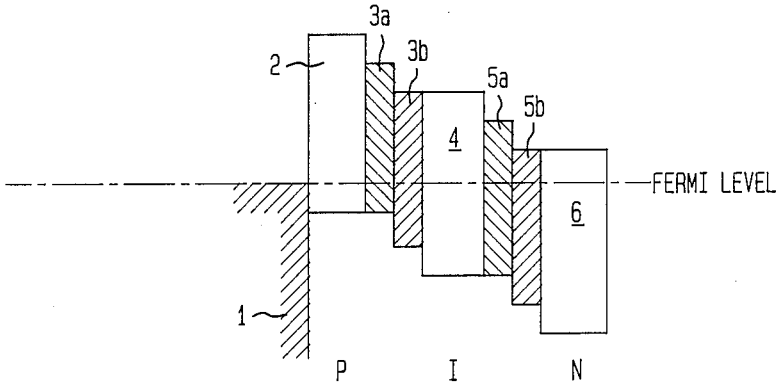
FIG. 3 shows a band gap view illustrating the constitution of the photosensitive member of the present invention used in a positively charged state.

FIG. 2 shows an embodiment wherein a depletion layer has been made in said photosensitive member. FIG. 3 shows a typical view illustrating by means of an energy level. Specifically, the photosensitive member of FIG. 2 used in a positively charged state, a depletion layer is formed in the junction regions of the N-type a-Si:Ge layer (5-*b*) and weak N-type a-Si:Ge layer (5-*a*) as well as weak P-type a-Si:Ge layer (3-*b*) and P-type a-Si:Ge layer (3-*a*). As a result, a large amount of carriers are generated in the a-Si:Ge layers by irradiation with light, and carriers (electrons) generated in the layers (5-*a*), (5-*b*), (3-*a*) and (3-*b*) are easily extracted into the a-Si layer (6). Similarly, carriers (holes) generated in said layers are easily extracted into the a-Si layer (2). Consequently, there occur no problems such as residual potential, memory, etc. The same applies to a large number of the layers such as that shown in FIG. 1-*d*. From FIG. 3, it can be seen that the first a-Si layer (2) is most strongly P-type and becomes weak in the a-Si:Ge layers (3*a*), (3*b*) but sufficient level difference to form the depletion layer therebetween. The second a-Si layer (4) is intrinsic and a-Si:Ge layers (5*a*), (5*b*) are both N-type with the depletion therebetween. The a-Si layer (6) is most strongly N-type. As noted above, B may be incorporated in the amount of up to about 200 ppm to control the conductivity to P, I or N-type. Further, P of less 50 ppm may be used to obtain N-type layer.

When the photosensitive member is to be negatively charged, it sufficies to reverse the adjustment of polarity shown in FIG. 2.

For the adjustment of polarity, it suffices to incorporate an atom belonging to Group III or V of the periodic table in the a-Si:Ge layer.

When the photosensitive member is used in a positively charged state, it is preferred that the amount of the atom of Group III is made rich toward the substrate side and poor toward the surface layer side. Also, the a-Si:Ge layers at the surface layer side may be made of N-type using a small amount of the atom of Group V, and those at the substrate side may be made of P-type using the atom of Group III.

When the photosensitive member is used in a negatively charged state, it is preferred that the amount of the atom of Group III is made poor toward the substrate side and rich at the surface layer. Also, by incorporating the atom of Group V in the substrate side, the surface layer may be made of P-type and the substrate side may be made of N-type.

The photosensitive member of the present invention can be produced by the usual methods for example as follows: An a-Si layer is deposited on a substrate (e.g. aluminum) by applying glow discharge to a mixed gas comprising $SiH_4$, $Si_2H_6$, suitable carrier gases (e.g. $H_2$, Ar) and required hetero atoms; an a-Si:Ge layer is then deposited on the a-Si layer by applying glow discharge to a mixed gas comprising $SiH_4$, $GeH_4$ and hetero atoms; and similarly, an a-Si layer is deposited on the a-Si:Ge layer.

The present invention will be illustrated hereinafter with reference to the following examples.

EXAMPLE 1:

Production of the Photosensitive member A

Figure 4:
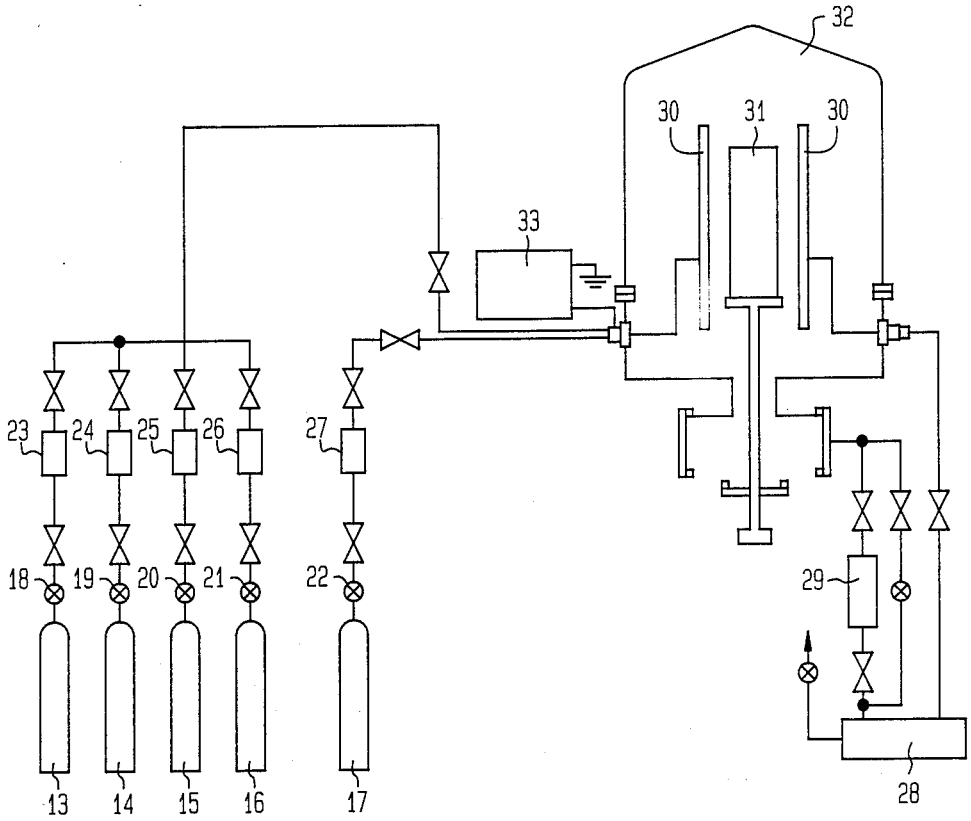
FIG. 4 shows a glow discharge decomposition apparatus for manufacturing the photosensitive member of the present invention.

Step (1):

In a decomposition apparatus with glow discharge shown in FIG. 4, the inner part of the reactor (32) was exhausted to a high vacuum of about $10^{-6}$ Torr by operating first a rotaty pump (28) and then a diffusion pump (29). After opening the 1st to 3rd and 5th controlling valves (18), (19), (20) and (22), $H_2$ gas in the 1st tank (13), 100% $SiH_4$ gas in the 2nd tank (14), $B_2H_6$ gas, diluted to 200 ppm with $H_2$, in the 3rd tank (15) and $O_2$ gas in the 5th tank (17) were sent to mass flow controllers (23), (24), (25) and (27), respectively, under an output gauge of 1 kg/cm$^2$. Thereafter, the flow amounts of $H_2$, $SiH_4$, $B_2H_6/H_2$ and $O_2$ gases were set on 494 sccm (standard cubic cm/min), 100 sccm, 5.0 sccm and 1.0 sccm, respectively, by adjusting the scales of the respective mass flow controllers, and every gas was sent to the reactor (32). After the flow rate of every gas was stabilized, the inner pressure of the reactor (32) was adjusted to 1.0 Torr. Separately, an aluminum drum of 80 mm in diameter, an electroconductive substrate (31), in the reactor (32) was heated to 250° C. in advance. At the point when both the flow rate of every gas and the inner pressure were stabilized, a high-frequency power source (33) was turned on and a power of 250 watts (frequency, 13.56 MHz) was applied to electrodes (30) to generate glow discharge. This glow discharge was continued for about 3.6 hours to deposit a first a-Si layer (2) of about 9 μm in thickness containing hydrogen, boron and a trace amount of oxygen on the electroconductive substrate (31) [(1) in FIG. 1].

Step (2):

At the point when the first a-Si layer was formed, application of power form the high-frequency power source (33) was stopped and at the same time, the flow amount of every mass flow controller was set on zero, and the reactor (32) was thoroughly degased. Thereafter, 474 sccm of $H_2$ gas, 100 sccm of 100% $SiH_4$ gas, 5 sccm of $B_2H_6$ gas diluted to 200 ppm with $H_2$, 20 sccm of $GeH_4$ gas and 1 sccm of $0_2$ gas were sent to the reactor from the 1st, 2nd, 3rd, 4th and 5th tanks [(13), (14), (15), (16) and (17)], respectively. After adjusting the inner pressure to 1.0 Torr, the high-frequency power source was turned on to apply a power of 250 watts. Glow discharge was continued for 24 minutes to deposit a first a-Si:Ge layer (3) of about 1 μm in thickness. The germanium content at that time was about 30 at%.

Step (3):

Procedure was carried out in the same manner as in Step (1) to form a second a-Si layer (4) of 10 μm in thickness.

Step (4):

Procedure was carried out in the same manner as in Step (2) to form a second a-Si:Ge layer (5) of 1 μm in thickness.

Step (5):

Procedure was carried out in the same manner as in Step (1) to form a third a-Si layer (6) of 9 μm in thickness.

The photosensitive member (A) thus obtained was set to a xerographic copying machine (EP 650Z; produced by Minolta Camera Co., Ltd.), and used for copying in a positively charged state. As a result, clear and high-density images superior in resolving power and good in gradation reproducibility were obtained. Continuous copying was carried out 50000 times, but reduction in image characteristics was not observed, and good copies were obtained to the last. Further, copying was carried out under a high-temperature and high-humidity condition such as 30° C.×85%, but the electrophotographic characteristics and image characteristics did not differ at all from those under room temperature conditions. The photosensitive member thus obtained is designated as Photosensitive member A hereinafter.

COMPARATIVE EXAMPLE 1:

Production of Photosensitive member S

A photosensitive member was obtained in the same manner as in Example 1 except that Steps (2), (3) and (4) were omitted, and that the thickness of the a-Si layer (2) was made 30 μm by Step (1) only. The photosensitive member obtained is designated as photosensitive member S hereinafter.

COMPARATIVE EXAMPLE 2:

Production of Photosensitive member T

The a-Si layer (2) of 28 μm in thickness and the a-Si:Ge layer (3) of 2 μm in thickness were prepared in the same manner as in Step (1) and Step (2), respectively, of Example 1. Thus, a photosensitive member comprising one layer each of a-Si and a-Si:Ge was obtained. The photosensitive member obtained is designated as Photosensitive member T hereinafter.

EVALUATION TEST 1

Figure 5:
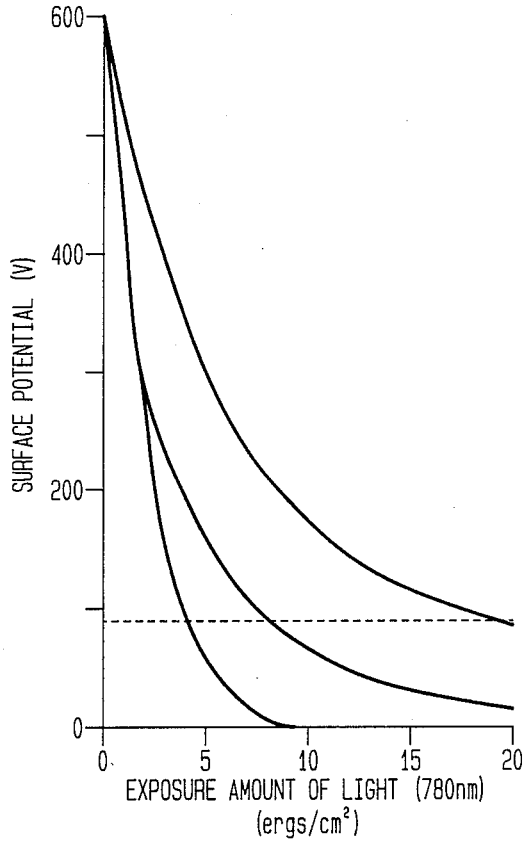
FIG. 5 shows a graph illustrating a relationship between exposure amount and decay of surface potential.

The foregoing Photosensitive members A, S and T were charged to a surface potential of 600 V by corona discharge, and the decay of the surface potential against exposure amount was measured by irradiating with laser ray having a wave length of 780 nm using a semiconductor laser. The result is shown in FIG. 5. The exposure amounts required for the surface potential to decay from 600 V to 100 V were about 19, about 8 and about 4 ergs/cm$^2$ for the photosensitive members S, T and A, respectively. It can be seen from this result that the photosensitive member of the present invention is extremely good in the practical sensitivity.

EXAMPLE 2

Production of Photosensitive member B

Steps (1) and (2) of Example 1 were repeated alternately to obtain a photosensitive member having a multi-layer structure of a-Si (6 μm)/a-Si:Ge (1 μm)/a-Si (7 μm)/a-Si:Ge (1 μm)/a-Si (7 μm)/a-Si:Ge (1 μm)/a-Si (7 μm). This photosensitive member is designated as Photosensitive member B hereinafter.

COMPARATIVE EXAMPLE 3

Production of Photosensitive member U

Procedure was carried out in the same manner as in steps (1) and (2) of Example 1 to obtain a photosensitive member having a structure of a-Si (27 μm)/a-Si:Ge (3 μm) layers.

EVALUATION TEST 2

The photosensitive members B and U were charged to 600 V and erased with light quantity of 58 lux.sec of a white fluorescent lamp. As a result, it was found that the residual potential of B was 40 V, and that of U was 130 V.

EVALUATION TEST 3

Using the photosensitive members A and B, practical copying was tried on LBP with semiconductor laser as a light source, and as a result, it was found that, even by high-speed printing, very clear and high-quality images were obtained and conventionally observable density difference on images based on the interference phenomenon was not generated at all.

EXAMPLES 3 AND 4 AND COMPARATIVE EXAMPLES 4 TO 6

Photosensitive members were produced according to the method of Example 1 except that the thickness of the a-Si and a-Si:Ge layers and the boron content of said layers were changed. The constitution, thickness and boron content of the photosensitive members obtained were as follows (in each of table, "constitution of layer" was listed from the top in the order of outermost surface layer to the substrate).

| Constitution of layer | Photosensitive member C | | Thickness of layer (μm) |
|---|---|---|---|
| | $B_2H_6/SiH_4$ (ppm) | $GeH_4$ (sccm) | |
| a-Si | 3 | — | 11 |
| a-Si:Ge (I) | 5 | 12 | 3 |
| a-Si:Ge (II) | 8 | | |
| a-Si | 10 | — | 2 |
| a-Si:Ge (I') | 13 | 12 | 3 |
| a-Si:Ge (II') | 16 | | |
| a-Si | 20 | — | 11 |

| Constitution of layer | Photosensitive member D | | Thickness of layer (μm) |
|---|---|---|---|
| | $B_2H_6/SiH_4$ (ppm) | $GeH_4$ (sccm) | |
| a-Si | 3 | — | 10 |
| a-Si:Ge (I) | 4 | 12 | 2 |
| a-Si:Ge (II) | 5 | | |
| a-Si | 7 | — | 2 |
| a-Si:Ge (I') | 9 | 12 | 2 |
| a-Si:Ge (II') | 10 | | |
| a-Si | 12 | — | 2 |
| a-Si:Ge (I') | 14 | 12 | 2 |
| a-Si:Ge (II') | 17 | | |
| a-Si | 20 | — | 10 |

| Constitution of layer | Photosensitive member X | | Thickness of layer (μm) |
|---|---|---|---|
| | $B_2H_6/SiH_4$ (ppm) | $GeH_4$ (sccm) | |
| a-Si | 10 | — | 30 |

| Constitution of layer | Photosensitive member Y | | Thickness of layer (μm) |
|---|---|---|---|
| | $B_2H_6/SiH_4$ (ppm) | $GeH_4$ (sccm) | |
| a-Si | 3 | — | 12 |
| a-Si:Ge | 10 | 12 | 6 |
| a-Si | 20 | — | 12 |

| Constitution of layer | Photosensitive member Z | | Thickness of layer (μm) |
|---|---|---|---|
| | $B_2H_6/SiH_4$ (ppm) | $GeH_4$ (sccm) | |
| a-Si | 3 | — | 12 |
| a-Si:Ge (I) | 5 | 12 | 6 |
| a-Si:Ge (II) | 17 | | |
| a-Si | 20 | — | 12 |

(12 sccm of $GeH_4$ corresponds to a-$Si_{0.83}Ge_{0.17}$).

EVALUATION TEST 4

Figure 6:
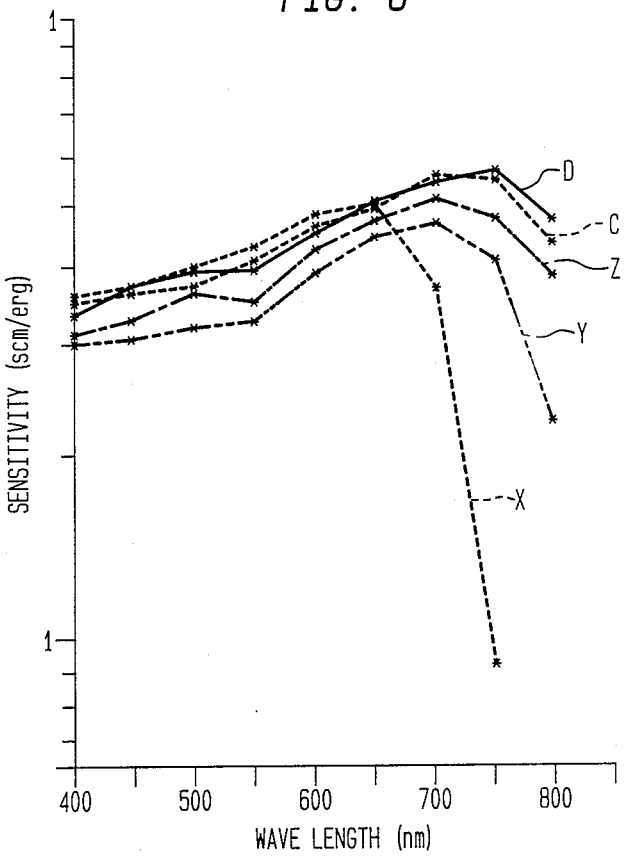
FIG. 6 shows a graph illustrating relationships between wavelength and sensitivity obtained with a photosensitive member having a depletion layer and a plural number of a-Si:Ge layers and that having neither of them.

The Photosensitive members C, D, X, Y and Z obtained in Examples 3 and 4 and comparative examples 4 to 6, respectively, were charged to 600 V by corona discharge, and then spectral sensitivity was measured to obtain the result shown in FIG. 6. In the figure, (C), (D), (X), (Y) and (Z) showed the results obtained with the photosensitive member C, D, X, Y and Z, respectively. The abscissa shows wavelength (nm) and the ordinate shows sensitivity (scm/erg). As is apparent from FIG. 6, it can be seen that the photosensitive member of the present invention has high sensitivity toward long wavelength light, and besides that its sensitivity toward short-wave light is not damaged. Consequently, it can be used for both LBP and PPC.

EVALUATION TEST 5

The Photosensitive members C, D, X, Y and Z were charged to 600 V, and then the residual potential at the point when the charge was erased with a light quantity of 8 lux.sec of a tungsten lamp was measured. The result is shown in Table 1.

TABLE 1

| Photosensitive member | X | Y | Z | C | D |
|---|---|---|---|---|---|
| Residual potential (V) | 112 | 48 | 37 | 2 | 2 |

It can be seen from Table 1 that the residual potential of the Photosensitive member C and D of the present invention is very low. This is based on that the photosensitive member of the present invention is superior in decay in a low electric field region at the latter half of the light decay curve (LDC).

EVALUATION TEST 6:

Using the Photosensitive members C and D of the present invention, practical copying was tried on LBP. As a result, clear images having no interference patterns are obtained.

What is claimed is:

1. An electrophotosensitive member which comprises on a conductive substrate, a plurality of amorphous silicon layers and a plurality of amorphous silicon:germanium layers wherein each of said amorphous silicon:germanium layers is interposed between two of said amorphous silicon layers so as not to come into direct contact with the substrate and surface and includes about 2 to 70 atomic % of germanium.

2. An electrophotosensitive member as claimed in claim 1 wherein each of said amorphous silicon:germanium layers has a thickness of about 50 Å to 20 μm and each of said amorphous silicon layers has a thickness of about 1 to 50 μm.

3. An electrophotosensitive member as claimed in claim 2 wherein the total thickness of the amorphous silicon:germanium layers is about 100 Å to 30 μm.

4. An electrophotosensitive member as claimed in claim 1 wherein each of said amorphous silicon layers and each of said amorphous silicon:germanium layers has a P-type conductivity in the vicinity of the substrate and an intrinsic or N-type conductivity in the vicinity of the surface layer.

5. An electrophotosensitive member as claimed in claim 4 wherein said P-type layers include less than about 200 ppm of an impurity element in Group IIIA of the Periodic Table.

6. An electrophotosensitive member as claimed in claim 4 wherein said N-type layers include less than about 50 ppm of an impurity element in Group VA of the Periodic Table.

7. An electrophotosensitive member as claimed in claim 1 wherein each of said amorphous silicon layers and each of said amorphous silicon:germaniun layers has an intrinsic or N-type conductivity in the vicinity of the substrate and a P-type conductivity in the vicinity of the surface layer.

8. An electrophotosensitive member as claimed in claim 7 wherein said P-type layers include less than about 200 ppm of an impurity element in Group IIIA of the Periodic Table.

9. An electrophotosensitive member as claimed in claim 7 wherein said N-type layers include less than about 50 ppm of an impurity element in Group VA of the Periodic Table.

10. An electrophotosensitive member as claimed in claim 1 wherein each of said amorphous silicon layers includes elements selected from a group consisting of carbon, oxygen and nitrogen.

11. An electrophotosensitive member as claimed in claim 1 wherein each of said amorphous silicon:germanium layers includes elements selected from a group consisting of carbon, oxygen and nitrogen.

12. An electrophotosensitive member as claimed in claim 1 wherein each of said amorphous silicon:germanium layers has a depletion layer.

13. An electrophotosensitive member which comprises on a conductive substrate, a plurality of amorphous silicon layers and a plurality of amorphous silicon:germanium layers wherein each of said amorphous silicon:germanium layers is interposed between two of said amorphous silicon layers and one of said amorphous silicon layers is formed on the conductive substrate and another of said amorphous silicon layers forms a surface layer, each of said amorphous silicon:germanium layers including about 2 to 70 atomic % of germanium and having a thickness of about 50 Å to 20 μm, each of said amorphous silicon layers having a thickness of about 1 to 50 μm, and said amorphous silicon:germanium layers having a total thickness of about 100 Å to 30 μm.

* * * * *